US008475011B2

(12) United States Patent
Kayanuma

(10) Patent No.: US 8,475,011 B2
(45) Date of Patent: Jul. 2, 2013

(54) LENS MEMBER AND OPTICAL UNIT USING SAID LENS MEMBER

(75) Inventor: Yasuaki Kayanuma, Fujiyoshida (JP)

(73) Assignees: Citizen Electronics Co., Ltd., Yamanashi (JP); Citizen Holdings Co., Ltd., Tokyo (JP)

( * ) Notice: Subject to any disclaimer, the term of this patent is extended or adjusted under 35 U.S.C. 154(b) by 295 days.

(21) Appl. No.: 13/095,123

(22) Filed: Apr. 27, 2011

(65) Prior Publication Data

US 2011/0261569 A1 Oct. 27, 2011

(30) Foreign Application Priority Data

Apr. 27, 2010 (JP) ..... 2010-102095

(51) Int. Cl.
*F21V 5/02* (2006.01)

(52) U.S. Cl.
USPC . 362/340; 362/326; 362/311.02; 362/311.09; 362/327; 362/335; 359/642

(58) Field of Classification Search
USPC ..... 362/311.02, 311.09, 327, 335, 340
See application file for complete search history.

(56) References Cited

U.S. PATENT DOCUMENTS

| | | | | |
|---|---|---|---|---|
| 5,613,769 | A * | 3/1997 | Parkyn et al. | 362/338 |
| 6,953,271 | B2 * | 10/2005 | Aynie et al. | 362/511 |
| 7,483,220 | B2 * | 1/2009 | Kittelmann et al. | 359/742 |
| 2010/0284194 | A1 | 11/2010 | Miyashita et al. | |

FOREIGN PATENT DOCUMENTS

| | | | |
|---|---|---|---|
| JP | 5755002 | A | 4/1982 |
| JP | 59119340 | A | 7/1984 |
| JP | 05281402 | | 10/1993 |

* cited by examiner

*Primary Examiner* — Stephen F Husar
*Assistant Examiner* — James Cranson, Jr.
(74) *Attorney, Agent, or Firm* — Browdy and Neimark, PLLC

(57) ABSTRACT

A lens member includes at least one of the annular prisms including a facet at an edge between an inner annular surface and an outer surface of the at least one of the annular prisms. The prisms with facets may be provided at a central portion of the lens member and the facets are configured to refract light toward a light-exit side of the lens member.

17 Claims, 8 Drawing Sheets

LENS MEMBER AND OPTICAL UNIT USING SAID LENS MEMBER

CROSS-REFERENCE TO THE RELATED APPLICATION

This application is based on and claims the priority benefit of Japanese Patent Application No. 2010-102095, filed on Apr. 27, 2010, the disclosure of which is incorporated herein by reference in its entirety.

BACKGROUND OF THE INVENTION

1. Field of the Invention

The present invention relates to a lens member and an optical unit including the lens member, used in, for example, Light-emitting diode (LED) lighting, and the like.

2. Related Art Statement

LED optical products such as lighting, projectors, flash, headlights and tail lamps of automobiles and the like, in which an LED is utilized as a light source, or basic optical devices such as a narrow directivity LED, and so on, generally use a lens for focusing or collimating the light emitted from the LED. Although a convex refractive lens is usually employed for this kind of lens, adoption of a Fresnel lens with the aim of height reduction and thinning is also proposed.

Conventionally, there is proposed a lens for a lamp fitting which has a lattice-shaped refracting prism formed in a central portion of the inner surface near the optical axis, and also has a lattice-shaped reflecting prism formed in a peripheral portion of this lattice-shaped refracting prism (refer, for example, to JP 57-55002 A). In addition, there is proposed a Fresnel lens in which a part of the prisms of the Fresnel lens surface acting as a light-entrance surface is formed such that a part of the entering light rays are emitted from the light-exit surface after being totally internally reflected at the non-lens surface (refer, for example, to JP 59-119340 A). Furthermore, there is proposed an optical device configured from a refractive lens portion having a lens body provided at a central portion of the optical axis and a reflecting body portion, the reflecting body portion allowing light rays to enter from an inner surface portion and totally internally reflecting the light rays at a paraboloid-shaped reflecting surface, thereby converting the light rays into a parallel beam (refer, for example, to JP 05-281402 A).

However, the above-mentioned conventional technology leaves the following problems. That is, in a conventional Fresnel lens, in the case that an edge of a prism is configured with a sharp angle by a prism light-entrance surface and a prism reflecting surface, during resin molding of the Fresnel lens when a metal mold is filled with resin, resin is prevented from reaching the edge of the prism because the edge is narrow or thin. This causes the edge of the prism in its molded state to have a rounded shape. Hence, there is a problem that light-entrance and reflection of light at the rounded edge of the prism cannot be performed with high precision, which results in deterioration of luminance performance in a direction of a central axis AX of the lens member, and so on.

In addition, the lens body disclosed in JP 05-281402 has the disadvantage that its reflecting surface must be high in order to reflect all of the light entering from a rounded shaped light-entrance surface, thereby causing lens thickness to be increased.

Furthermore, the lenses disclosed in JP 57-55002 A, JP 59-119340 A, and JP 05-281402 A have the disadvantage that a loss is generated due to a part of the entering light not reaching the reflecting surface, making it difficult to maximize usage efficiency of the light. For example, in JP 05-281402 A, there is a portion between the light-entrance surface and the refractive lens portion where the entering light does not reach the reflecting surface, resulting in loss of the light passing through this portion.

In addition, when an LED is used as the light source, the radiated light has a light distribution in which the greater the emission angle the smaller the light intensity; therefore, as shown in FIG. 3, when a conventional TIR (Total Internal Reflection) lens 1 is used, the light entering from the light-entrance surface of the inner concave lens portion 3 of the TIR lens 1 disposed to face the light source 2 is totally internally reflected at the reflecting surface of the outer convex lens portion 4; however, this results in the light L2 of relatively strong light intensity in the central portion vicinity being reflected at the reflecting surface at the outer peripheral side of the convex lens portion 4.

Consequently, in this TIR lens 1, brightness in the central vicinity is high, but becomes low in the intermediate vicinity and rises again at the outside. As a result, even if this TIR lens 1 is turned into a Fresnel lens, if a conventional method is used to do so, ring-shaped flare centered on the optical axis is generated in the exiting light which spoils the appearance.

Furthermore, in the lens disclosed in JP 05-281402 A, the light-entrance surface and light-exit surface of the reflecting lens portion are both formed as non-spherical surfaces, and there is therefore a problem that both processing is difficult and costs rise.

SUMMARY OF THE INVENTION

A lens member in accordance with an embodiment of the present invention including a light-entry side that includes a central axis, a concave shape with the central axis centered, a light-exit side opposite to the light-entry side, a plurality of annular prisms provided on the light-entry side and concentric with the central axis of the light-entry side, the plurality of annular prisms each including an inner annular surface and an outer annular surface that is positioned outside of the inner annular surface to form each of the annular prisms, and at least one of the annular prisms including a facet at an edge between the inner annular surface and the outer annular surface of the at least one of the annular prisms.

The facet may be an annular slope rising from the inner annular surface to the outer annular surface of the annular prism.

The at least one of the annular prisms may be a plurality of annular prisms with facets and may be positioned at a central portion around the central axis of the light-entry side.

The inner annular surfaces and the outer annular surfaces of the annular prisms are formed in a shape of Fresnel lens surface.

In another embodiment of the present invention, the lens member may include a protruding portion protruding at the central portion with the central axis of the light-entry side centered, and the plurality of annular prisms with the facets that are concentric with the central axis may be provided on a slope of the protruding portion. The protruding portion may include a conical shape and the plurality of annular prisms with the facets may be provided on a slope of the conical shape around the central axis.

Regarding a protruding end of the protruding portion, the protruding end may have a flat surface perpendicular to the central axis or may have an aspheric surface.

The inner annular surfaces of the annular prisms may be formed with divided portions of a light-entrance surface of a TIR lens and the outer annular surfaces of the annular prisms may be formed with divided portions of the light-reflection surface of the TIR lens in which the light-entrance surface includes a concave shape provided at a lower portion of the TIR lens and the light reflection surface includes a convex shape positioned outside of the light-entrance surface. In divided portions of the light-reflection surface of the TIR lens, the divided portion originally positioned away from a central axis of the TIR lens is relocated to the outer annular surfaces of the annular prisms that are positioned adjacent to the central axis of the light-entry side, and in each of the annular prisms, the outer annular surface may be a total-internal reflection surface that reflects light passing through the inner annular surface of each of the annular prisms. The inner annular surfaces and the outer annular surfaces of the annular prisms may be formed in a shape of Fresnel lens surface, fresnel-ized from the TIR lens with the divided portions that are originally positioned away from the central axis of the TIR lens, relocated adjacent to the central axis of the light-entry side.

Furthermore, in the lens member according to another embodiment of the present invention, a plurality of minute irregularities may be disposed on the light-exit side and configured to control directivity of light passing through the light-exit surface. The irregularities may be diffusing portions of light.

Moreover, an optical unit including a lens member in accordance with an embodiment of the present invention and a light source including at least one light-emitting diode element and a light-emitting surface with an optical axis centered, the optical axis of the light source being disposed coaxially with the central axis of the light-entry side of the lens member. The at least one light-emitting diode element may be a plurality of light-emitting diode elements and may include RGB light-emitting diode elements.

DETAILED DESCRIPTION OF THE PREFERRED EMBODIMENTS

Figure 1:
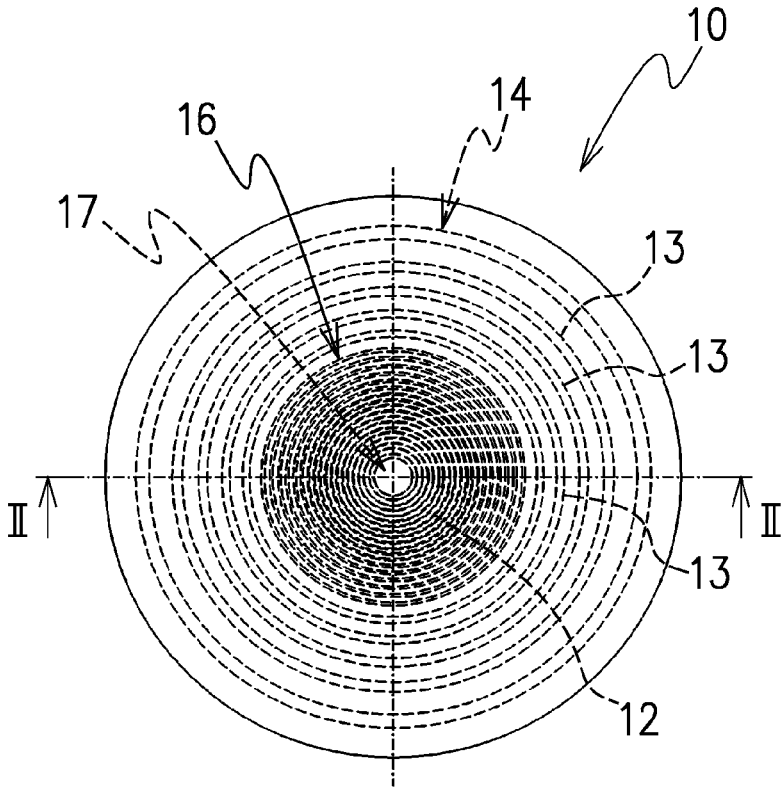
FIG. 1 is a plan view of a lens member in an embodiment of the present invention.

The present invention now will be described more fully hereinafter with reference to the accompanying drawings, in which embodiments of the invention are shown. The present invention may, however, be embodied in many different forms and should not be construed as limited to the specific embodiments set forth herein. Rather, these embodiments are provided to convey the scope of the invention to those skilled in the art. In the drawings, the size and relative sizes of layers and regions may be exaggerated for clarity.

Figure 2:
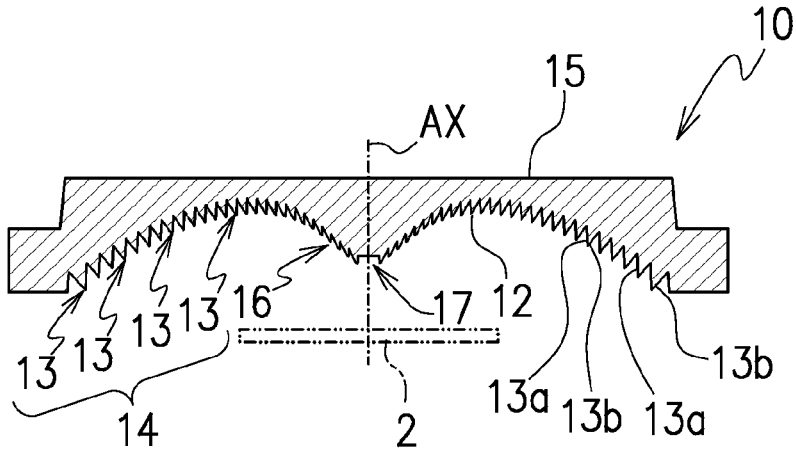
FIG. 2 is a cross-sectional view taken along the line II-II of the lens member shown in FIG. 1.

FIGS. 1 and 2 show a lens member 10 in accordance with an embodiment of the present invention. For more details, the lens member 10 includes a light-entry side 12 that includes a central axis AX, a concave shape with the central axis centered, a light-exit side 15 opposite to the light-entry side 12, and a plurality of annular prisms 13 provided on the light-entry side 12 and concentric with the central axis AX of the light-entry side 12. The plurality of annular prisms 13 each includes an inner annular surface 13*a* and an outer annular surface 13*b* that is positioned outside of the inner annular surface 13*a* to form each of the annular prisms 13. The central axis AX of the light-entry side 12 coincides with a central axis AX of the lens member 10.

Figure 6:
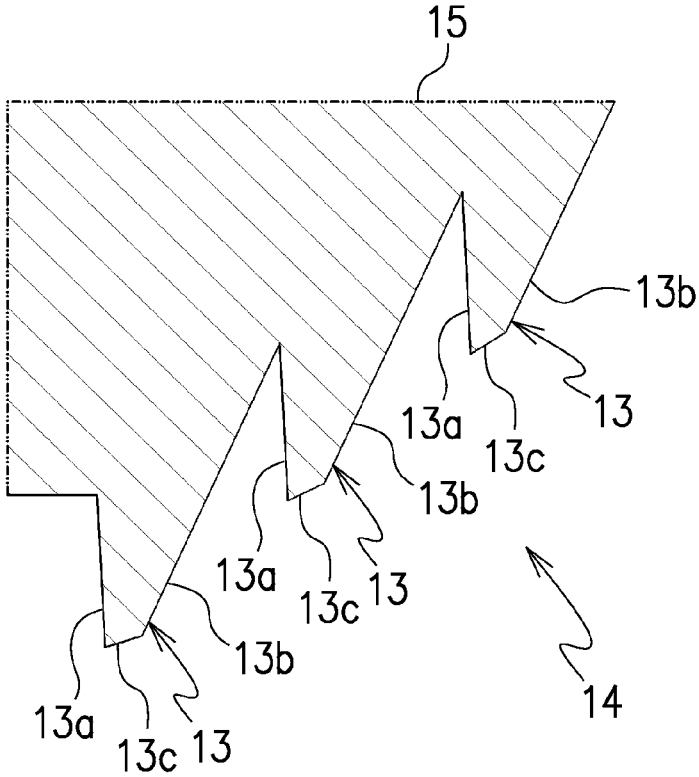
FIG. 6 is an enlarged cross-sectional view showing shapes of facets provided at edges between inner annular surfaces and outer annular surfaces of annular prisms of the lens member in a lens member according to embodiments of the present invention.

As shown in FIG. 6, at least one of the annular prisms 13 includes a facet 13*c* between the inner annular surface 13*a* and the outer annular surface 13*b* of the at least one of the annular prisms 13. Here, a plurality of facets 13*c* are provided between the inner annular surfaces 13*a* and the outer annular surfaces 13*b* of the annular prisms 13 and the facets 13*c* are configured to receive light that is emitted from the light source 2 and refract the light directly toward the light-exit side 15. The facet 13*c* may be an annular flat slope rising from the inner annular surface 13*a* to the outer annular surface 13*b* of the annular prism 13.

Also, regarding an angle between the inner annular surface 13*a* and the facet 13*c* of the annular prism 13, a first annular prism disposed closer to the central axis AX, compared with a second annular prism, has a larger angle between the inner annular surface 13*a* and the facet 13*c* of the first annular prism. In other words, though the width of the first annular prism disposed closer to the central axis AX is smaller or narrower than the width of the second annular prism, the angle between the inner annular surface 13*a* and the facet 13*c* of the first annular prism has a larger angle than that of the second annular prism. Regarding the annular slope of the facet 13*c*, the slope of the second annular prism that is positioned outside the first annular prism becomes steeper. The slope of the annular prisms becomes steeper with the distance from the central axis AX. Accordingly, in this embodiment, annular prisms 13 with facets 13*c* are provided in a central portion with the central axis AX centered and annular prisms without facets are provided in a peripheral portion around the central portion. This is because, even if facets are provided at edges of annular prisms in the peripheral portion, the angles between the inner annular surfaces 13*a* and the facets 13*c* become too small and the slopes of the facets 13*c* become too steep to receive and refract light from the light source 2 toward the light-exit side 15 properly.

Figure 7A:
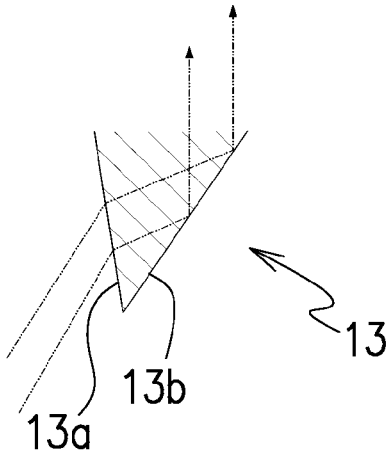
FIG. 7A is a simplified explanatory diagram showing an optical path when an edge of the annular prism has an ideal pointed shape.
Figure 7B:
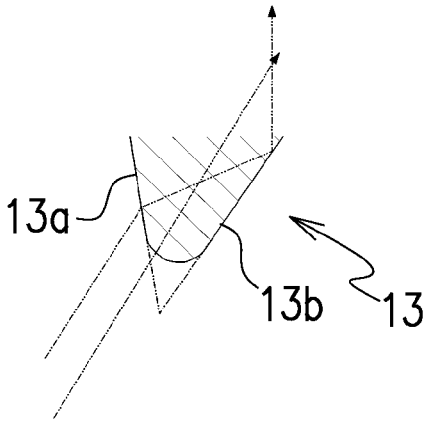
FIG. 7B is a simplified explanatory diagram showing an optical path when an edge of the annular prism is rounded.

FIG. 7A is a simplified explanatory diagram showing an optical path when an edge of the annular prism has an ideal pointed shape that is formed by a die in which resin is ideally sufficiently filled at its edge of the annular prism. FIG. 7B is a simplified explanatory diagram showing an optical path when an edge of the annular prism is rounded and the edge is formed by a die in which resin is not fully filled at its edge portion of the annular prism. In this case of FIG. 7B, desired light refraction at the rounded edge toward the light-exit side 15 does not take place, and therefore, luminance performance in a direction along central axis AX is deteriorated due to loss of light that is uncontrollable at the rounded edge portion of the annular prism.

Figure 7C:
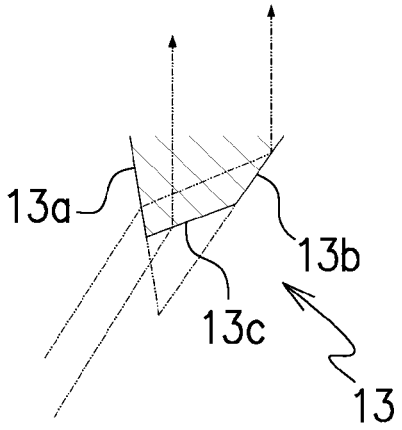
FIG. 7C is a simplified explanatory diagram showing an optical path when a facet is provided at an edge between the inner annular surface and the outer annular surface of the annular prism.

In contrast, in the embodiment of the present invention, as shown in FIG. 7C, since the facet 13*c* is provided at the edge between the inner annular surface 13*a* and outer annular surface 13*b* of the annular prism 13, molding the lens member 10 becomes easier without needing to form pointed edges at minute or narrow annular prisms in the central portion of the lens member 10. As a result, the facets 13*c* receive light with the incident angle to be refracted toward the light-exit side 15.

Figure 8C:
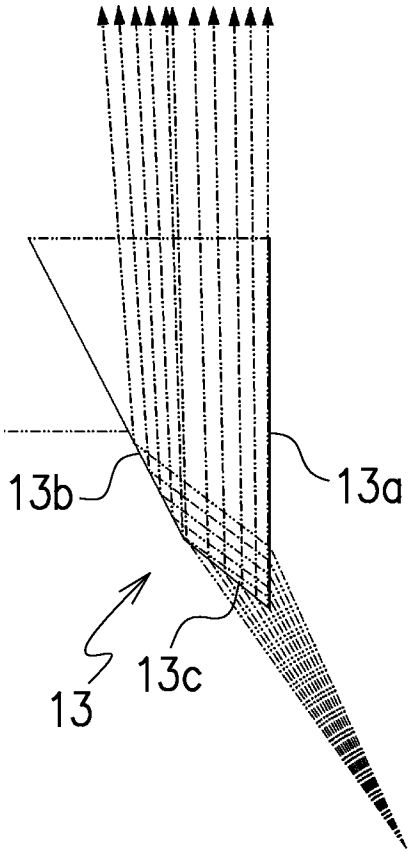
FIG. 8C is an explanatory diagram showing an optical path when a facet is provided at an edge between the inner annular surface and the outer annular surface of the annular prism.
Figure 8B:
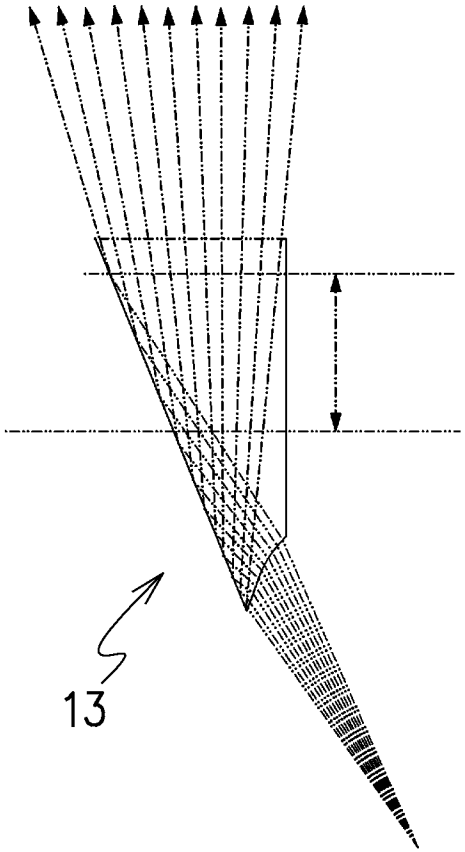
FIG. 8B is an explanatory diagram showing an optical path when an edge of the annular prism is rounded.
Figure 8A:
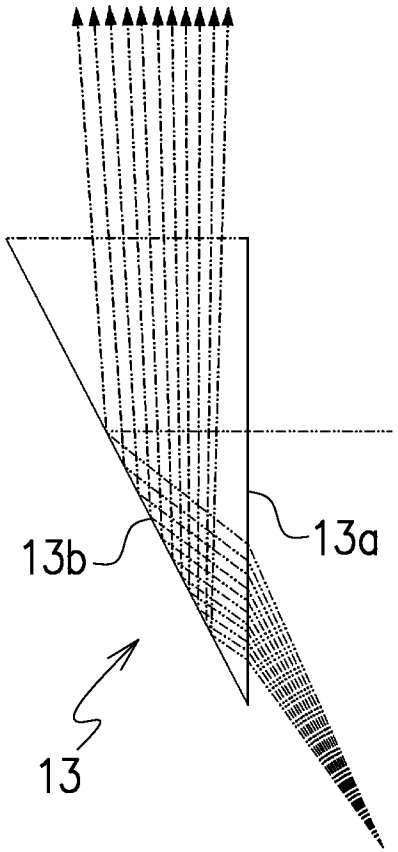
FIG. 8A is an explanatory diagram showing an optical path when an edge of the annular prism has an ideal pointed shape.
Figure 9:
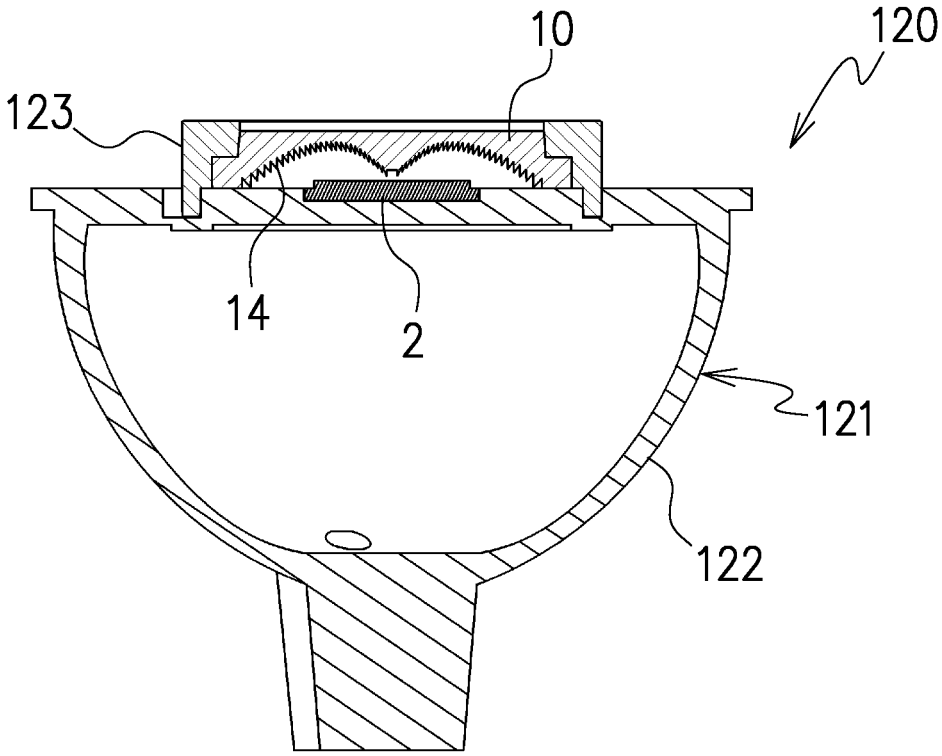
FIG. 9 is a cross-sectional view of an optical unit including the lens member in the first embodiment and a light source that faces a light-entry side of the lens member.
Figure 10:
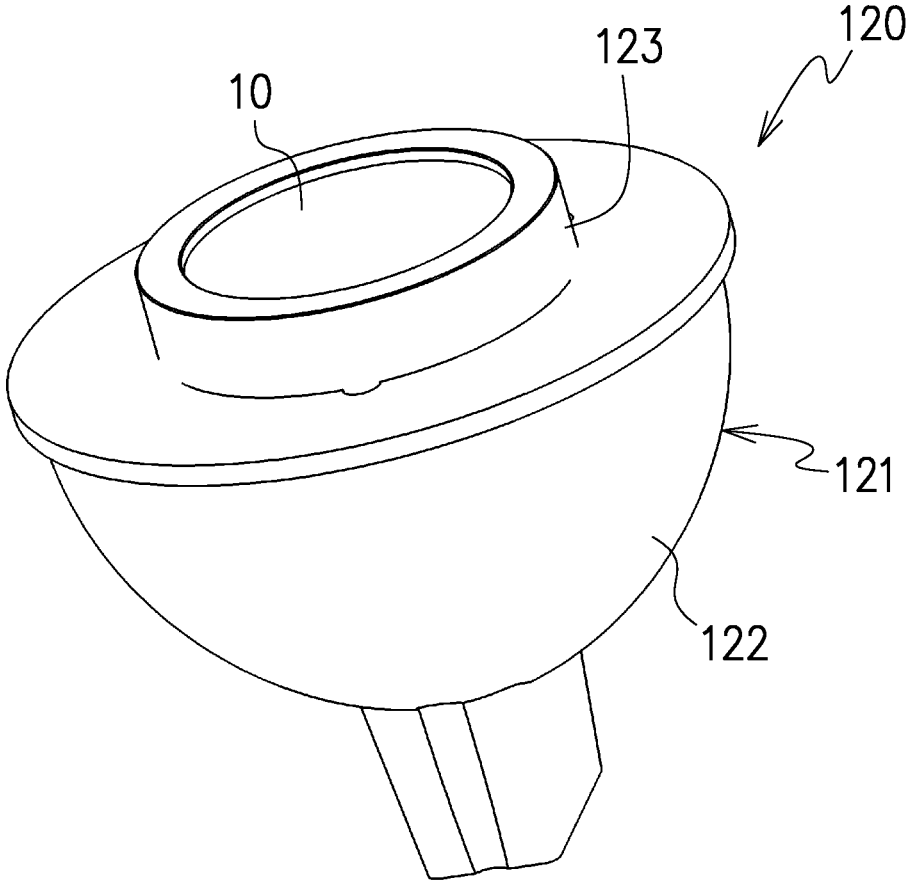
FIG. 10 is a perspective view of the optical unit shown in FIG. 9.

Moreover, compared with the case of the ideal shape shown in FIG. 8A, in the case of the technology disclosed in previously-mentioned JP 05-281402 as shown in FIG. 8B, the edge is rounded and easier to be molded. However, compared with the annular prism 13 with the facet 13*c* shown in FIG. 8C, the height of the annular prism 13 of FIG. 8B with the rounded edge is required to be higher for the outer annular surface 13*b* which results in the lens becomes thicker and makes thinning of the lens difficult. Accordingly, as shown in FIG. 8C, the facet 13*c* can be a light-receiving surface in addition to inner annular surface 13*a*, and it is easier to form the annular prisms with facets than to form annular prisms with edges of pointed shape by molding.

Figure 11:
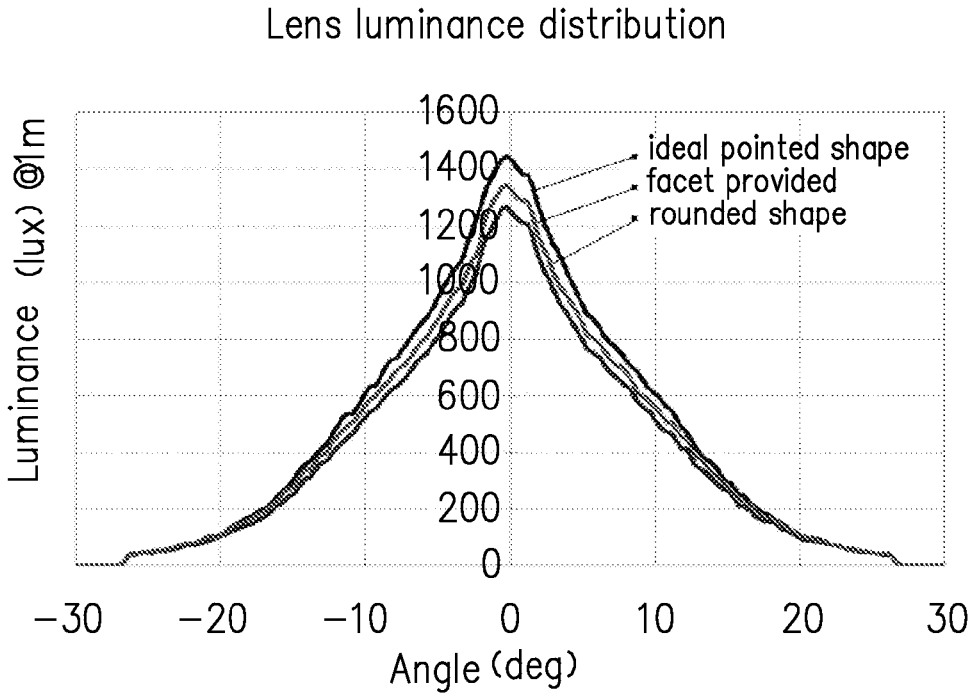
FIG. 11 is a graph showing a lens luminance distribution due to simulation for the different cases of shapes of edges of the annular prism.

Next, FIG. 11 shows that lens luminance distribution of the cases mentioned above in FIGS. 7A-7C and FIGS. 8A-8C; annular prisms with edges of "ideal pointed shape", annular prisms with "facet 13*c* provided" at edges and the annular prisms with facets provided at a central portion of the light-entry side, and annular prisms with edges of "rounded shape" at the central portion of the light-entry side because of insufficient filling resin of molding.

In addition, luminance performance in a direction along a central axis AX of the lens member 10 in each of the cases and ratios of the luminance performance are shown in Table 1 below, provided the luminance performance in the case of annular prisms with edges of "ideal pointed shape" is assumed to be 100 percent.

TABLE 1

| | luminance performance | ratio |
|---|---|---|
| ideal pointed shape | 1425.9 | 100% |
| rounded shape | 1237.4 | 87% |
| facet provided | 1315.5 | 92% |

Table 1 above shows that the annular prisms with facets at the central portion of the light-entry side have 92 percent of luminance performance, far better than the 87 percent of luminance performance of the annular prisms with rounded edges at the central portion of the light-entry side. The light performance of annular prisms with facets can be improved closer to the light performance of annular prisms with ideal pointed shape, and furthermore, it is possible to form the annular prisms with facets thinner than the annular prisms of other cases as mentioned above.

Figure 3:
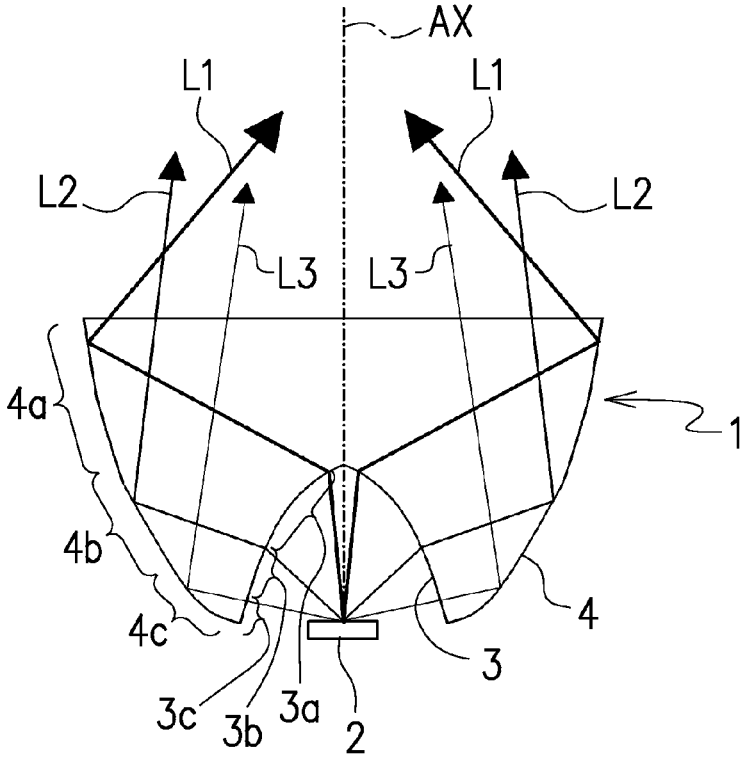
FIG. 3 is an explanatory diagram showing a principle of a conventional TIR lens.
Figure 4:
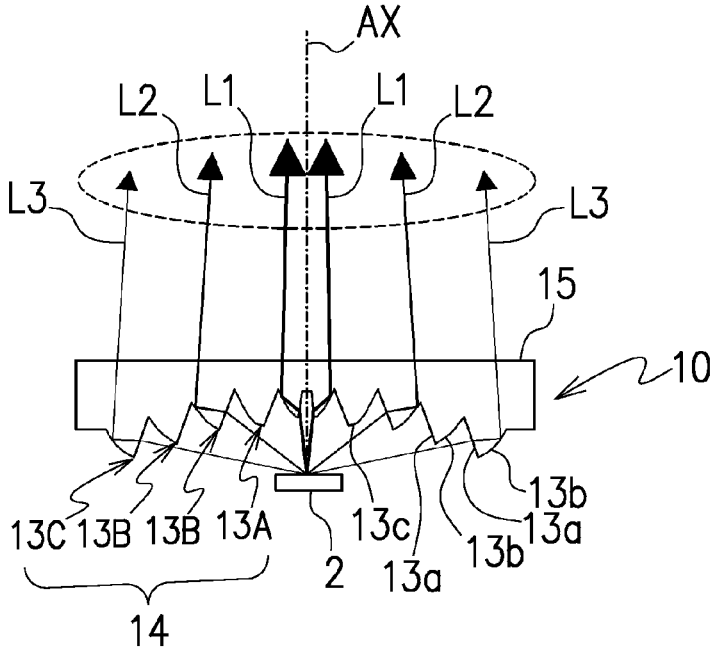
FIG. 4 is an explanatory diagram showing a principle of the lens member including a Fresnel surface, fresnel-ized from the TIR lens with the divided portions that are originally positioned away from the central axis of the TIR lens, relocated adjacent to the central axis of the light-entry side of the lens member.

Furthermore, as shown in FIGS. 3 and 4, the inner annular surfaces 13*a* and the outer annular surfaces 13*b* are formed in a shape of Fresnel lens surface.

Figure 5:
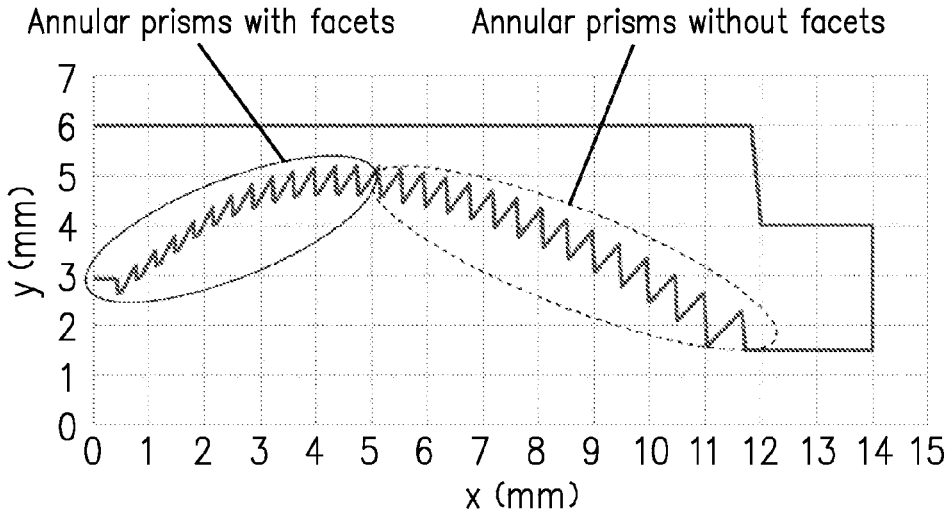
FIG. 5 is an explanatory diagram of a light-entry side showing a partial cross-sectional view of a central portion where annular prisms with facets are provided and a peripheral portion around the central portion, the peripheral portion where annular prisms without facets are provided in a lens member according to embodiments of the present invention.

FIGS. 1, 2 and 5 show that the lens member 10 includes a protruding portion 16 protruding at the central portion with the central axis AX of the light-entry side 16 centered, and the plurality of annular prisms 13 with facets 13*c* are provided on a slope of the protruding portion 16 at the central portion around the central axis AX and annular prisms 13 without facets are provided in a peripheral portion around the protruding portion. Furthermore, the protruding portion 16 may include a conical shape as a whole and the plurality of annular prisms with the facets 13*c* may be provided on a slope of the conical shape around the central axis AX. A protruding end 17 or an apex of the protruding portion 16 may include a flat surface perpendicular to the central axis AX or may include an aspheric surface.

As shown in FIGS. 3 and 4, the inner annular surfaces 13*a* of the annular prisms 13 may be formed with divided portions 3*a*, 3*b*, and 3*c* of a light-entrance surface 3 of a TIR lens 1 and the outer annular surfaces 13*b* of the annular prisms 13 may be formed with divided portions 4*a*, 4*b*, and 4*c*, of the light-reflection surface 4 of the TIR lens 1 in which the light-entrance surface 3 includes a concave shape provided at a lower portion of the TIR lens 1 and the light-reflection surface 4 includes a convex shape positioned outside of the light-entrance surface 3 of the TIR lens 1. In the divided portions 4*a*, 4*b*, and 4*c* of the light-reflection surface 4 of the TIR lens 10, the divided portions 4*a* originally positioned away from a central axis AX of the TIR lens 10 away from a central axis AX of the TIR lens is relocated to the outer annular surfaces of the annular prisms that are positioned adjacent to the central axis AX of the light-entry side, and in each of the annular prisms 13, the outer annular surface 13*b* is a total-internal reflection surface that reflects light passing through the inner annular surface 13*a* of each of the annular prisms 13. The inner annular surfaces 13*a* and the outer annular surfaces 13*b* of the annular prisms 13 are formed in a shape of Fresnel lens surface, fresnel-ized or divided from the TIR lens with the divided portions that are originally positioned away from the central axis AX of the TIR lens, relocated adjacent to the central axis of the light-entry side. Thus, a lens member 10 in the present embodiment can be a plate-shaped lens having a Fresnel lens surface 14 as the plurality of annular prisms 13 at the light-entry side 12. The annular prisms 13A-13C having angles of light refraction that differ from each other. The TIR lens 1 is disposed to face a light source 2 that includes at least one of light-emitting diode element (LED element) with the central axis AX of the TIR lens 1 and an optical axis AX of the light source 2 coincided with each other. Note that this lens member 10 is integrally formed from a light-transmitting resin.

Consequently, each of the annular prisms 13 has an apex angle that changes according to position relative to the central axis AX of the lens member 10, the apex angle here is the angle between the inner annular surface 13*a* and the outer annular surface 13*b* of the annular prism 13.

The inner annular surfaces preferably include planar surfaces and the outer annular surfaces preferably include planar surfaces in processing treatment, but may include quadric surfaces such as parabolic surfaces, hyperboloidal surfaces, or ellipsoidal surfaces.

The inner annular surfaces 13*a* include inclinations to the optical axis AX to face the light-emitting surface of the light source 2. Note that, in the present embodiment, a light-exit side 15 may be a planar surface.

Next, an optical unit including the above-mentioned lens member 10 according to the present invention and a light source 2, and a casing 121 that supports the lens member 10 and the light source 2.

The casing 121 includes a hemispherical portion 122 and a circular surface closing the hemispherical portion 122, and the light source 2 is installed in a center of the circular surface, and a lens-support frame 123 disposed at the circular surface around the light source 2 to support the lens member 10 above the light source 2 and the lens member 10 is disposed to face the light source 2 with the central axis AX of the lens member 10 and the optical axis of the light source 2 coincided with each other.

Furthermore, the Fresnel lens surface 14 of the present embodiment is configured such that the more outwardly positioned of the divided portions 4*a*-4*c* of the conventional light reflection surface 4 that are divided into a plurality of outer annular surfaces 13*b* of prisms 13. The divided portion 4*a* of the light-reflection surface 4 of the TIR lens, the divided portion 4*a* that is most distant from the central axis AX of the TIR lens is relocated to the outer annular surfaces of the annular prisms adjacent to the central axis AX of the lens member 10, and the divided portion 4*c* of the light-reflection surface 4 of the TIR lens, the divided portion 4*c* that is closest to the central axis AX of the TIR lens is relocated to the outer annular surfaces of the annular prisms that are disposed at the peripheral portion, most distant from the central axis AX of the lens member 10. As a result, light of strong light intensity in the central portion enters the Fresnel lens unit 14 from the prism light-entrance surface 13*a* of the prism 13A in the central portion and is totally internally reflected at the prism light-reflecting surface 13*b* of that prism 13A.

Consequently, the lens member 10 can receive relatively strong light at the central portion of the lens member 10, compared to the conventional TIR lens. Brightness at the central portion of the lens member with gradation of light intensity from the center to the peripheral portion of the lens member 10 can be improved.

In addition, because each of annular prisms includes a inner annular surface 13*a* and an outer annular surface 13*b* and the annular prisms are continuously disposed adjacent to the central axis AX to the peripheral portion of the light-entry side of the lens member 10, light entering through the inner annular surface 13*a* reaches the outer annular surface 13*b* in each of the annular prism 13 is totally internally reflected toward the light-exit surface along the central axis Ax, and therefore, luminance performance can be efficiently improved.

Hence, in the optical unit 120 comprising such a lens member 10 capable of achieving high luminance performance along a direction of the central axis AX of the lens member 10 and so on, usage efficiency of the light emitted from the LED-configured light source 2 is high, and LED optical products and so on, such as lighting, projectors, flash, headlights and tail lamps of automobiles and the like, that have good appearance, can be obtained.

Next, further embodiment of the lens member and optical unit in accordance with the present invention is described below with reference to FIG. 12. Note that in the following description of the embodiment, identical symbols are assigned to elements of configuration identical to those described in the above-described embodiment, and a detailed description thereof is omitted.

Figure 12:
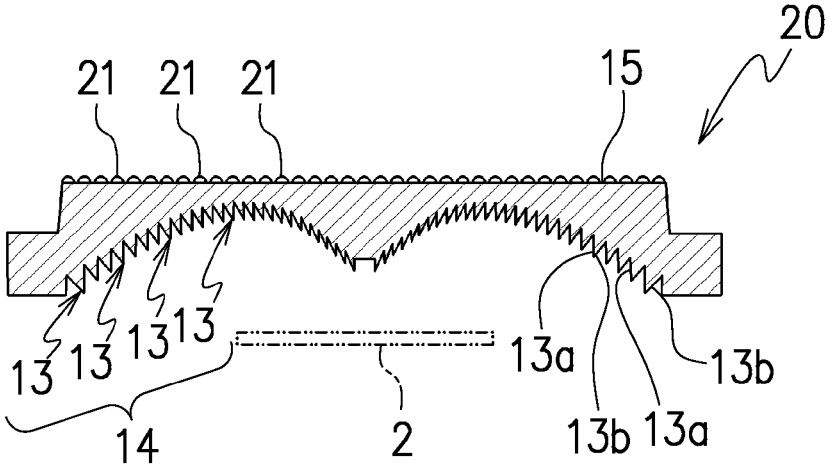
FIG. 12 is a cross-sectional view of a lens member in a second embodiment of the present invention.

The second embodiment differs from the first embodiment in that, whereas in the first embodiment, the light-exit side 15 on the opposite side to the light-entry side 14 is a planar surface, in a lens member 20 of the second embodiment, as shown in FIG. 12, a plurality of minute irregularities 21 that are configured to diffuse light passing through the light-exit side. The minute irregularities may diffuse light passing through the light-exit side to decrease variations of emitted light through the light-exit side.

Note that the irregularities 21 on a central portion of the light-exit side 15 of the lens member 20 may be configured to have a higher diffusion than those on an outer peripheral side, since intensity of light at the central portion is stronger than that at the peripheral portion.

Note that the present invention is not limited to each of the above-described embodiments and it should be understood that various alterations may be made to the embodiments within a range not departing from the scope and spirit of the present invention.

For example, an optical sheet for controlling at least one of diffusion and directivity of transmitted light may be installed on the light-exit side.

That is, the light-exit side, in addition to having irregularities formed directly thereon, may also be installed with an optical sheet such as a diffusion sheet for uniformly scattering transmitted light, and an anisotropic diffusion sheet or prism sheet for scattering or refracting a large amount of transmitted light in a specific direction, thereby allowing a large variety of diffusion and directivity characteristics of light to be set as required. Note that a material having a small difference in refractive index with the material of the lens member main body is preferably adopted for the optical sheet.

By installing an optical sheet for controlling at least one of diffusion and directivity of transmitted light on the light-exit side in this way, it becomes easy for light that has been light-harvested to a maximum extent by the Fresnel lens unit to be emitted with a desired diffusion and directivity by refraction and scattering due to the optical sheet on the light-exit side.

What is claimed is:

1. A lens member comprising:

a light-entry side including a central axis and a concave shape with the central axis centered;

a light-exit side opposite to the light-entry side;

a plurality of annular prisms provided on the light-entry side and concentric with the central axis of the light-entry side, the plurality of annular prisms each including an inner annular surface and an outer annular surface that is positioned outside of the inner annular surface to form each of the prisms; and at least one of the annular prisms including a facet at an edge between the inner annular surface and the outer annular surface of the at least one of the annular prisms.

2. The lens member according to claim 1; wherein the at least one of the annular prisms including the facet comprise a plurality of concentric annular prisms with facets, and the plurality of concentric annular prisms with the facets are positioned at a central portion around the central axis of the light-entry side.

3. The lens member according to claim 2, further comprising;

a protruding portion protruding at the central portion with the central axis of the light-entry side centered; and the plurality of annular prisms with the facets, concentric with the central axis and provided on a slope of the protruding portion.

4. The lens member according to claim 3, wherein the protruding portion has a conical shape with the plurality of annular prisms with the facets provided on the slope of the conical shape around the central axis.

5. The lens member according to claim 1, wherein the facet is an annular slope rising from the inner annular surface to the outer annular surface of the at least one of the annular prisms.

6. The lens member according to claim 2, wherein the facets of the plurality of annular prisms are annular slopes each rising from the inner annular surface to the outer annular surface of each of the annular prisms.

7. The lens member according to claim 2, wherein a protruding end of the protruding portion has a flat surface perpendicular to the central axis.

8. The lens member according to claim 2, wherein a protruding end of the protruding portion has an aspheric surface.

9. The lens member according to claim 1, wherein the inner annular surfaces and the outer annular surfaces of the annular prisms are formed in a shape of Fresnel lens surface.

10. The lens member according to claim 1, further comprising:

a plurality of minute irregularities disposed on the light-exit side and configured to control directivity of light passing through the light-exit side.

11. The lens member according to claim 10, wherein the plurality of minute irregularities are configured to diffuse light passing through the light-exit side.

12. The lens member according to claim 1, wherein each of the inner annular surfaces comprises a planar surface and each of the concentric outer annular surfaces comprises a planar surface.

13. The lens member according to claim 1, wherein each of the inner annular surfaces comprises a planar surface and each of the concentric outer annular surfaces comprises a quadric surface.

14. The lens member according to claim 1, wherein the inner annular surfaces of the annular prisms are formed with divided portions of a light-entrance surface of a TIR lens, and the outer annular surfaces of the annular prisms are formed with divided portions of a light-reflection surface of the TIR lens in which the light-entrance surface has a concave shape provided at a lower portion of the TIR lens and the light-reflection surface includes a convex shape positioned outside of the light-entrance surface, and wherein, in the divided portions of the light-reflection surface of the TIR lens, the divided portions originally positioned away from a central axis of the TIR lens are relocated to the outer annular surfaces of the annular prisms that are positioned adjacent to the central axis of the light-entry side, and in each of the annular prisms, the outer annular surface is a total-internal reflection surface that reflects light passing through the inner annular surface and the facet of each of the annular prisms.

15. The lens member according to claim 13, wherein the inner annular surfaces and the outer annular surfaces of the annular prisms are formed in a shape of Fresnel lens surface, fresnel-ized from the TIR lens with the divided portions that are originally positioned away from the central axis of the TIR lens, relocated adjacent to the central axis of the light-entry surface.

16. An optical unit, comprising:

the lens member recited in claim 1; and a light source including at least one light-emitting diode element and a light-emitting surface with an optical axis centered, the optical axis of the light source being disposed coaxially with the central axis of the light-entry side.

17. The optical unit according to claim 16, wherein the at least one light-emitting diode element is a plurality of light-emitting diode elements including RGB-color of light-emitting diode elements.

* * * * *

UNITED STATES PATENT AND TRADEMARK OFFICE

CERTIFICATE OF CORRECTION

PATENT NO. : 8,475,011 B2
APPLICATION NO. : 13/095123
DATED : July 2, 2013
INVENTOR(S) : Yasuaki Kayanuma It is certified that error appears in the above-identified patent and that said Letters Patent is hereby corrected as shown below:

In the Claims

At claim 7, column 9, line 24, delete “claim 2” and insert --claim 3--;
At claim 8, column 9, line 27, delete “claim 2” and insert --claim 3--.

Signed and Sealed this
Fourteenth Day of October, 2014

Michelle K. Lee

Michelle K. Lee
*Deputy Director of the United States Patent and Trademark Office*